US005429495A

United States Patent [19]

Shimek et al.

[11] Patent Number: 5,429,495

[45] Date of Patent: Jul. 4, 1995

[54] METHOD AND APPARATUS FOR ENHANCING THE LENGTH AND COLOR OF GAS FLAMES

[75] Inventors: Ronald J. Shimek, 6665 W. Hwy. 13, Savage, Minn. 55378; James F. Wolf, Prior Lake, Minn.; Daniel C. Shimek, 6665 W. Hwy. 13, Savage, Minn. 55378

[73] Assignees: Ronald J. Shimek; Daniel C. Shimek, both of Savage, Minn.

[21] Appl. No.: 36,955

[22] Filed: Mar. 25, 1993

[51] Int. Cl.[6] ..... F23Q 2/32

[52] U.S. Cl. ..... 431/126; 126/512

[58] Field of Search ..... 431/126; 126/512

[56] References Cited

U.S. PATENT DOCUMENTS 4,940,407 7/1990 Rehberg et al. ..... 431/126

4,992,041 2/1991 Kewish et al. ..... 431/126

*Primary Examiner*—Carroll B. Dority

*Attorney, Agent, or Firm*—John B. Sowell

[57] ABSTRACT

Method and means for enhancing the visible length and color of high efficiency gas flames in an artificial gas log fireplace/gas burner system is characterized by selecting from a plurality of metallic salt compounds, compounds having a low melting point and the ability to exhibit light in the visible spectrum when the metallic salt compounds absorb energy from a gas flame. The metallic salt compounds are placed in a high temperature area of the burner system adjacent the gas flames so that at the melting point of the metallic salt an ionized vapor is generated which is directed into the path of the combustion air being supplied to the gas burner. The energy level of the ionized metallic salt compounds are elevated and when subsequently cooled, they emit light in the visible spectrum which combines with the gas flames and colors the invisible flame spectrum so that the invisible gas flames become visible and appear longer and exhibit natural colors.

20 Claims, 4 Drawing Sheets

METHOD AND APPARATUS FOR ENHANCING THE LENGTH AND COLOR OF GAS FLAMES

BACKGROUND OF THE INVENTION

1. Field of the Invention

The present invention relates to high efficiency and low carbon monoxide gas burner systems of the type employed with artificial gas logs. More particularly, the present invention relates to a method and apparatus for adding a predetermined amount of metallic salt vapor to the gas to be burned by the gas burner system so that the relatively short invisible blue gas flames appear both longer and colored.

2. Description of the Prior Art

The American National Standards Institute (ANSI) Emission and Safety Standards Z-21.50 (1986) only permits 200 parts per million of carbon monoxide when burning gaseous fuels such as natural gas, manufactured gas and propane. These gasses when burned for high efficiency, high carbon dioxide and low carbon monoxide are known to display a blue color which is typical of the color produced by a gas stove burning natural gas.

Attempts have been made to meet the ANSI pollution standards and to also change the blue gas flame to an orange gas flame which is typical of the flames produced when wood is burned on a grate with an adequate supply of combustion air.

In our U.S. Pat. No. 4,875,464, a gas burner system is shown and described which does meet ANSI pollution standards and does produce gas flames which simulate the size and color of flames produced by wood burning logs. This simulated effect was produced by using hot metal shields to direct the gas flames away from the artificial logs which would act as a heat sink and raise the carbon monoxide to prohibitive levels. Further, the fuel air ratio was set at a near critical level in order to produce the desirable orange colored flames.

In our U.S. Pat. No. 5,000,162, a gas burner system is shown and described which simulates the size and color of glowing embers and which also meets ANSI pollution standards. Heretofore, glowing embers were designed to resemble hot glowing coals or wood charcoal which did not exhibit flames.

It is known that heat-stable metal compounds enhance the combustion of carbonaceous fuels. U.S. Pat. No. 4,992,041 shows and describes ceramic tubes which have a slurry mixture coating of aluminum oxide, soda lime glass and a metallic compound based thereon. The dense slurry which contained a small percentage of metallic compound was formed as a baked coating 1/16th to 1/32nd inch thick on a ¼ inch tube. The treated ceramic tubes were placed in the secondary reaction zone of the gas flame where the gas temperatures falls in the range between 1200° F. to 1600° F. which is sufficient to affect the release of atoms of metal into the primary reaction zone of the gas flame where they undergo ionizations. The explanation in this patent contends that the ionized atoms when they reach a cooler portion of the flame relax to lower energy levels and emit light characteristic of the light emitting metallic ions. This explanation clearly describes the necessity for driving an ion from the outer orbit of the metallic atom to produce the ionization effect so that when the excited atoms relax to a lower energy level they emitted light characteristic of that metallic ion.

The applicants of the present invention have determined that it is not necessary to ionize the metallic compounds in order to produce a colored light characteristic of the metallic elements. This is not to say that some ionization does not occur in the hot zone but it is possible to drive the metallic elements to a higher energy level so that when they collapse to a lower energy level, they do emit light without ionization.

It would be desirable to provide a method and apparatus for enhancing the length and color of primary gas flames in a gas burner system and at the same time, producing a more brilliant display of glowing embers which can be provided with visible natural colored flames associated with the glowing embers.

SUMMARY OF THE INVENTION

It is a primary object of the present invention to provide a method and apparatus for producing a long lasting, longer and more brilliant flame in a gas burner system which more nearly simulates the color of burning wood.

It is another primary object of the present invention to provide a novel formed, open or porous carrier for producing gas vapor which is passed into the primary air of a gas burner system.

It is another primary object of the present invention to provide a novel support or carrier for containing metallic salt compounds which are vaporized and used in a novel gas burner system.

It is another primary object of the present invention to provide a novel support for metallic salt compounds for use in a gas burner system which permits rapid replacement or replenishment of the metallic salts for flame enhancement and/or change of the flame colorization.

It is another object of the present invention to provide a method and means for economically changing or maintaining a color and flame enhancement feature in a gas burner system using artificial logs.

According to these and other objects of the present invention, there is provided a gas burner system for artificial logs having one or more apertured gas pipe burners located below the logs. A support or carrier is located in a hot zone near at least one of the gas pipe burners in the path of the primary combustion air. Heat from the gas burner is sufficient to vaporize a controlled amount of highly volatile metallic salt which is provided in the support or carrier attached to the burner system so that the embers, and the long and short gas flames in the burner system appear to have longer flames and more brilliantly colored flames which simulate wood being burned.

DESCRIPTION OF THE PREFERRED EMBODIMENT

Figure 1:
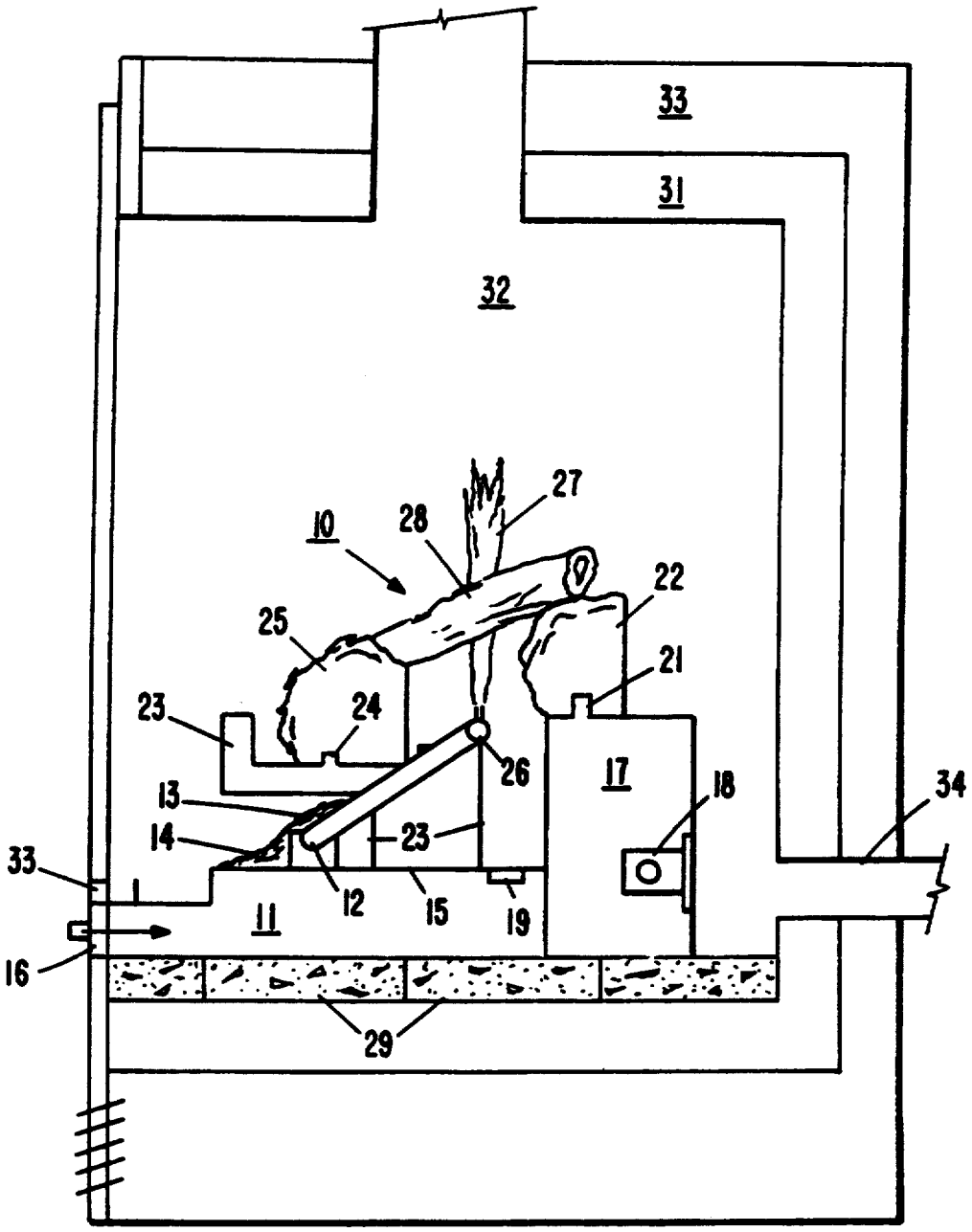
Figure 1 (Prior Art)
FIG. 1 is a schematic drawing in cross-section of a prior art clean burning gas log system and clean burning gas ember system shown in a fabricated steel metal fireplace enclosure.

Refer now to FIG. 1 showing a schematic drawing in cross-section of a prior art clean burning gas log system 10. The system 10 is shown mounted on a box or tray 11 which also serves as a heat exchanger. A first burner system 12 is shown located on top of tray 11 below a fire resistant material 13 such as rock wool or mineral wool which serves as the glowing embers for the prior art system 10. Additional embers or glowing embers 14 may be placed in front of the first burner 12 to form a shroud or cover concealing the burner 12. Support 15 is shown forming the top wall of the heat exchanger plenum 11 which has an inlet and outlet for circulating room air in the front of the plenum 11. The rear of the heat exchanger 11 is provided with a vertical enlargement 17 which houses a gas valve 18 that is electrically connected to a thermostat 19 (not shown). The vertical enlargement 17 is provided with a mounting pin 21 for supporting the rear artificial log 22. A grate or support 23 is also provided with a guide pin 24 for supporting a front artificial log 25. A rear burner 26 is placed between the logs 22 and 25 and provides a long flame 27 which rises in the space between the artificial logs 22, 25. In the preferred embodiment, the cross-log 28 is positioned so that it does not interfere with the flames 27. The whole burner system 10 may be provided as an insert unit or provided in a new fabricated fireplace of the type which has a refractory wall floor 29 and a dead air space 31 which surrounds the combustion chamber 32. A secondary heat exchanger 33 surrounds the dead air space 31 which may be made using thin steel sheets. In the prior art system shown in FIG. 1, room air may enter the inlet 34 where it is drawn over the first burner 12 and into the combustion system to the second burner 26. However, if no room air is used in the system, the inlet 16 is closed and fresh air is drawn into the system through the outside fresh air inlet 34, where it is first drawn to the second burner 26 and onto the first burner 12 reversing the flow of primary combustion air previously described. Further, the fresh air inlet 34 may be conducted by a duct to the front of the burner or even entered underneath the burner in a manner described in our U.S. Pat. No. 4,793,322. Thus, it will be explained that the present invention is not limited to any particular type of prefabricated fireplace or burner system as will be explained.

Figure 2:
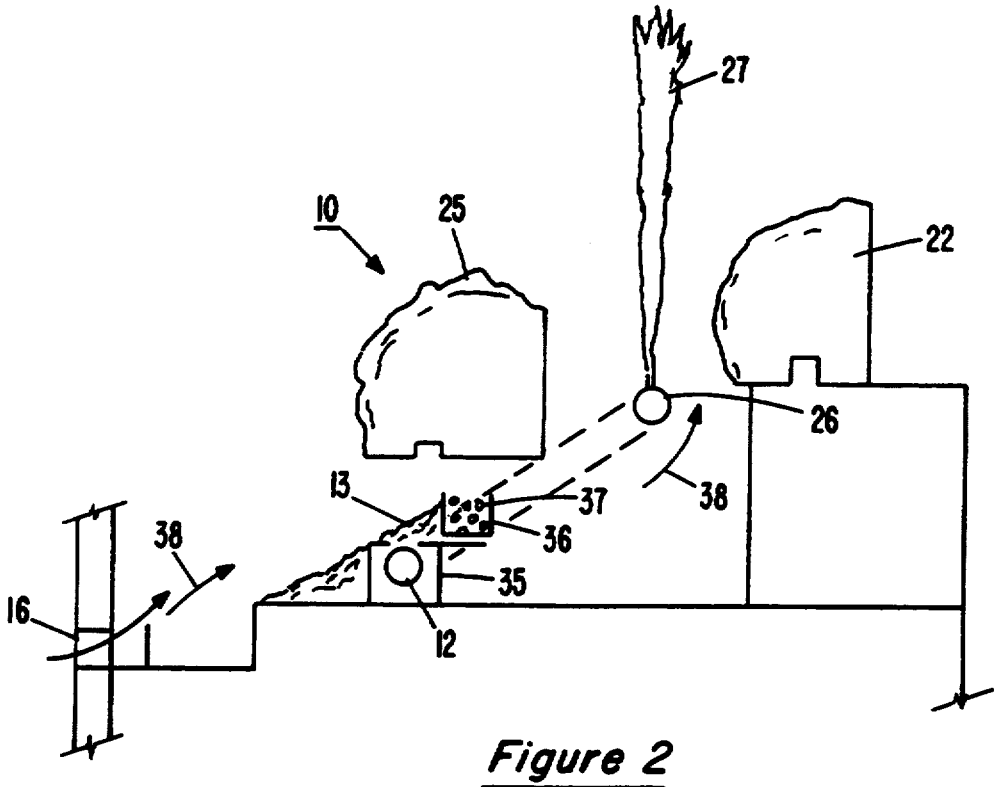
FIG. 2 is an enlarged drawing in cross-section of the gas burner system of FIG. 1 showing a preferred embodiment flame enhancement structure.

Refer now to FIG. 2 showing an enlarged drawing in cross-section of the gas burner system 10 of FIG. 1 and showing a preferred embodiment flame enhancement structure. The first or front burner 12 is shown surrounded by a screen support 35 which supports the glowing embers 13. The ember support 35 is shown supporting a carrier or trough 36 which contains the volatile metallic salts 37 which are near enough to the heat produced by the front burner 12 to melt some volatile salt, thus vaporizing salt vapor ions thus releasing them into the primary air stream 38 which passes over the glowing embers as well as into the front burner system 12. The primary combustion air stream 38 carries the gaseous metallic vapors past the rear or second burner 26 and into the long and hot flames 27. The gaseous metallic vapors are then further excited and their energy levels raised even though they are already in an ionized state. Upon cooling when reaching the cooler portions of the flame 27, the excited salt vapor ions relax and emit light characteristic of the particular metallic ion. It will be noted that the trough 36 which contains the volatile metallic salts 37 are easily accessible by removing the cross-log 28 and front log 25. In the preferred embodiment system shown, it is estimated that the amount of metallic salts 37 in the trough 36 are sufficient to last for a period of three to five years during normal usage before requiring any replenishment or replacement.

A feature of the present invention is that the glowing embers 13 also pull some of the salt vapor ions from the metallic salts 37 to the front of the log 25 where they enter the hot portion of the flame from the front burner 12. The flame from the front burner 12 is substantially invisible, however, when the ionized gaseous metallic salts enter into the hot portion of the ember flame, the invisible portion of the ember flame now becomes visible and substantially elongated and cause a curtain of flame having the color characteristic of the metallic ions. Further, the ionized vapor metallic salts which are carried into the rear or second burner 26 further elongate the visible long flames 27 while also coloring and enhancing them. This is all accomplished by a single source of metallic salts carried in a carrier 36 located in a warm zone adjacent to the front burner 12.

Figure 3:
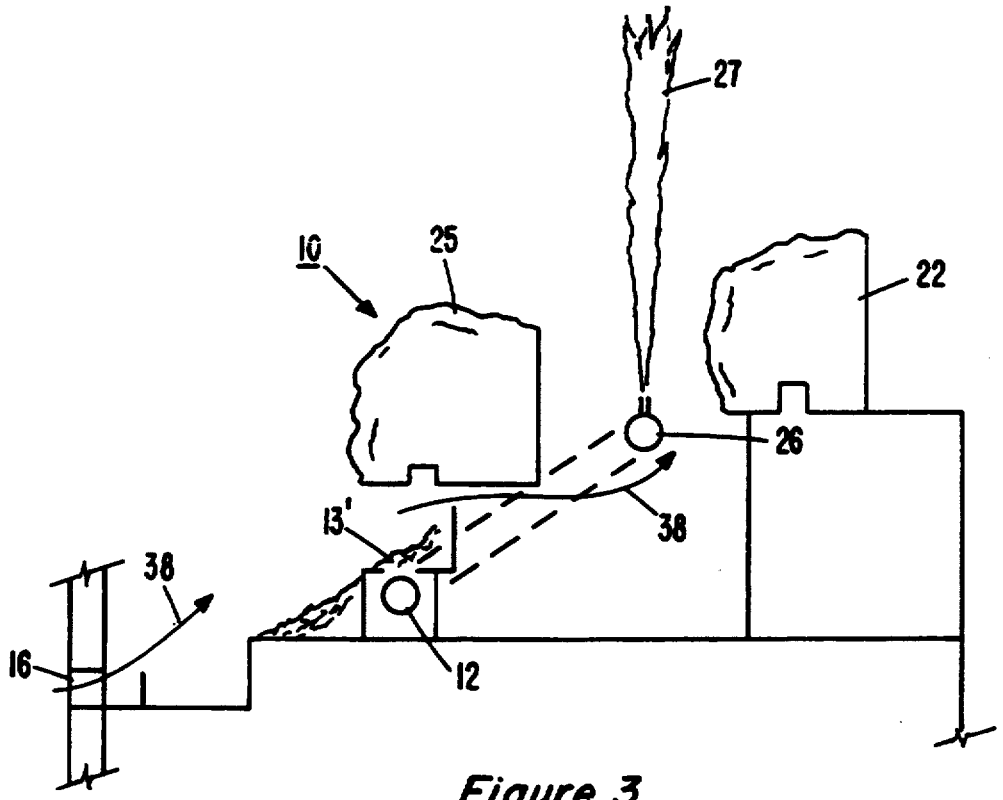
FIG. 3 is an enlarged drawing of the gas burner system of FIGS. 1 and 2 showing another preferred embodiment flame enhancement structure.

Refer now to FIG. 3 showing an enlarged drawing of a gas burner system 10 similar to the gas burner system 10 in FIG. 2. The prior art glowing embers 13 have been replaced with a new glowing ember structure 13' which comprises a high temperature ceramic wool which has been saturated by an aqueous solution of highly volatile metallic salts and air dried or bake dried to form a source of ionized metallic gas vapor as well as a glowing mass similar to the prior art glowing embers described in our U.S. Pat. No. 5,000,162. When the metallic salts are placed in a hotter portion of the front burner system 12 a larger amount of ionized vapor metallic salts are released and the system does not last as long as the preferred system shown in FIG. 2.

Figure 4:
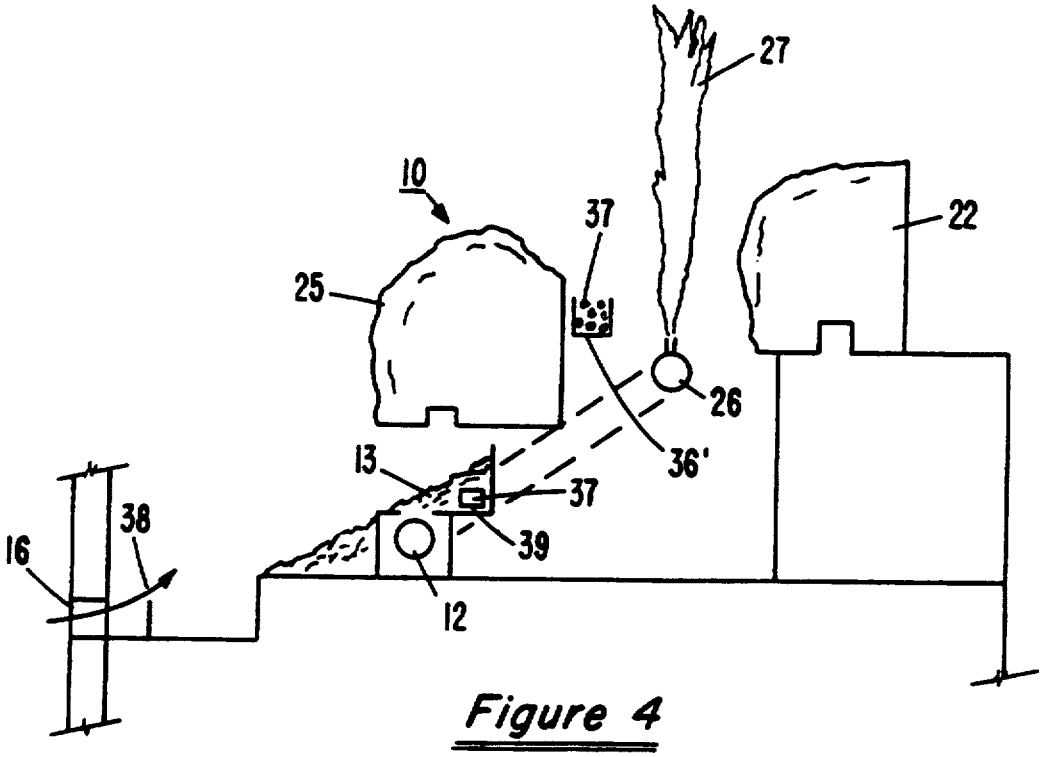
FIG. 4 is a schematic drawing of the gas burner system of FIG. 2 showing a first modified flame enhancement structure.
Figure 5:
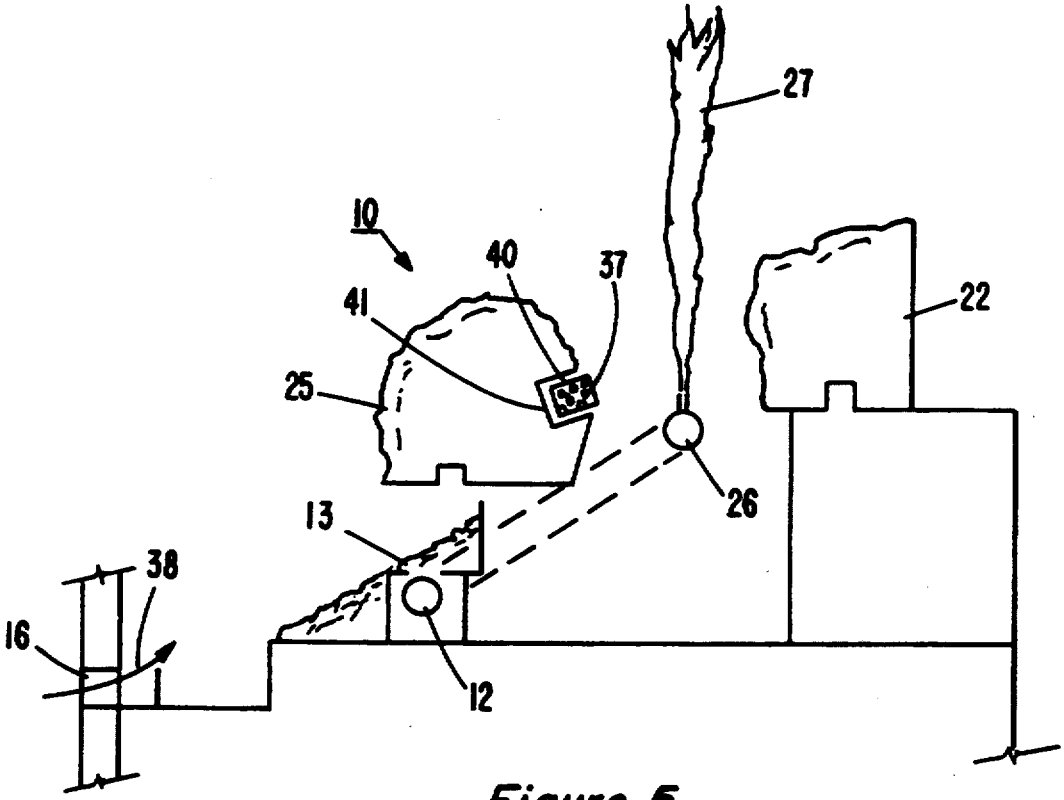
FIG. 5 is a schematic drawing of the gas burner system of FIG. 2 showing a second modified flame enhancement structure.

Refer now to FIG. 4 showing a schematic drawing of the gas burner system 10 of FIG. 2 and showing a first modified flame enhancement structure. The system of FIG. 4 includes glowing embers 13 under which is provided a small sheath or carrier 39 which contains the preferred embodiment high volatile metallic salts 37. Since the amount of metallic salts ions produced by the carrier 39 is insufficient to substantially enhance the long flames 27, a second carrier 36' is mounted on a rear surface of the front log 25 in a hot area of the burner system 10 which is sufficient to produce the desired amount of vapor of metallic salts. In the second modification shown in FIG. 5, the metallic salts 37 may be in one of three forms and are inserted in a slot or recess 41 in the front ceramic log 25. The metallic salts 37 may be placed in a flexible carrier which may be made from a high temperature ceramic wool or may be encased by a perforated or meshed type screen which can be placed in the trough 41. Alternatively, the volatile metallic salts may be made into pellet or puck or rod form by preparing a highly concentrated aqueous solution which is held together by high temperature ceramic fibers. Preferably a cast mass is dried out to leave a porous shaped pellet, rod or puck. In the FIG. 5 embodiment, one of the previously explained forms of providing ionized volatile metallic salts shown in FIGS. 3 and 4 must be provided for the front burner 12. An advantage of the solid type of puck or rod 40 is that it becomes soft and spongy when its useful life has been expended and may easily be tested for replacement.

Figure 6:
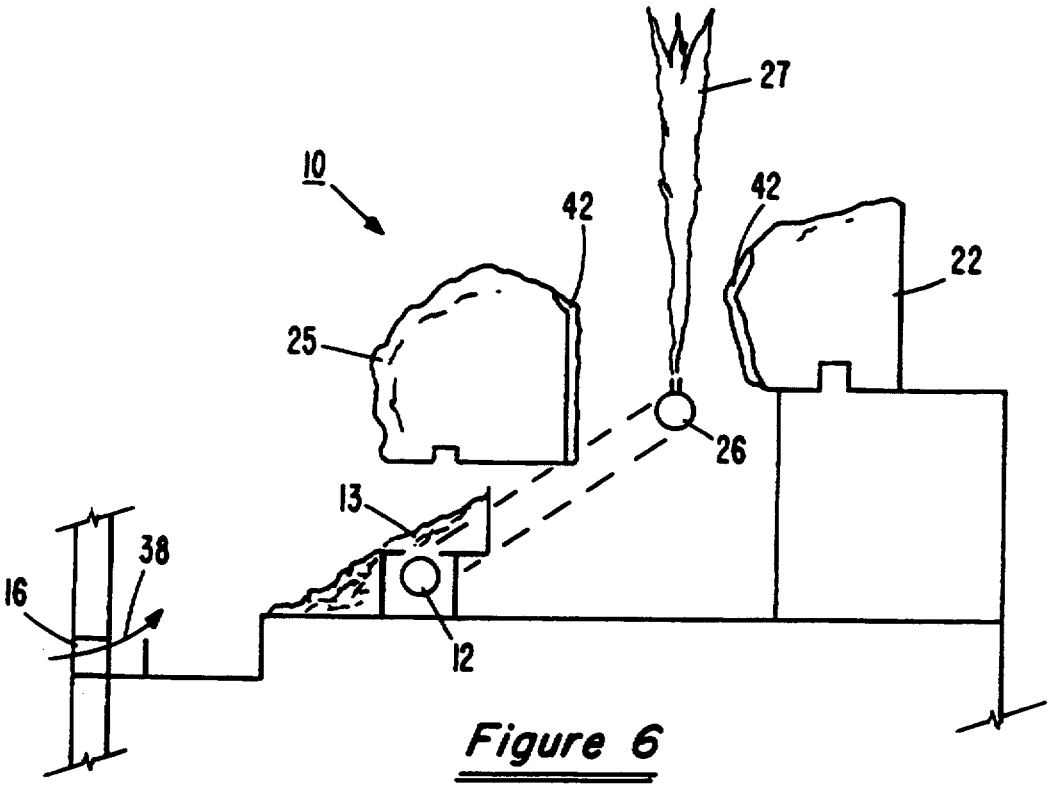
FIG. 6 is a schematic drawing of the gas burner system of FIG. 2 showing a third modified gas enhancement structure.

Refer now to FIG. 6 showing a schematic drawing of the gas burner system 10 of FIG. 2 and showing a third modified embodiment. The same material that was used to form the cast pucks or rods 40 in the FIG. 5 embodiment was sprayed onto a surface of either or both logs 22 and 25 on the surface opposite the flame 27. The applied layer 42 comprises a highly concentrated aqueous solution held together by a ceramic fiber which resists heat. In this embodiment, the layer 42 may be applied with a spray gun or brush and built up to a layer as thick as a quarter inch which adheres to the ceramic logs 22 and 25 whether porous or not. An advantage of this system is that when the layer becomes spongy and exhausted, it may be brushed away and replaced with a new aqueous solution which may be applied with a brush. Once applied the heat of the flame 27 is sufficient to drive off all of the water and leave the desired built up porous metallic salt layer. Again, the glowing embers 13 if they are to be enhanced and colored must be provided with the same enhancement shown in FIGS. 3 or 4 explained herein before or a modified form of the solid material 40 placed under the glowing embers 13.

Figure 7:
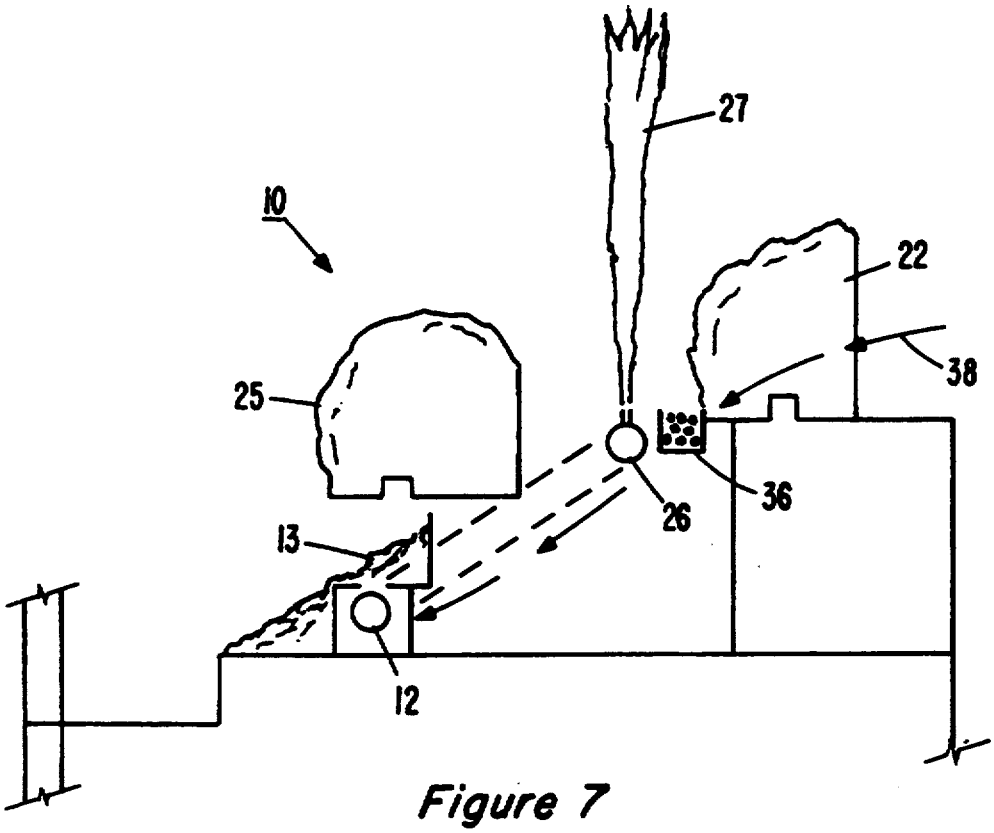
FIG. 7 is a schematic drawing of the gas burner system of FIG. 2 showing a fourth modified flame enhancement structure.

Refer now to FIG. 7 showing a schematic drawing of the gas burner system 10 of FIG. 2 and showing a fourth modified flame enhancement structure. In this modification, the primary air 38' is shown entering to the rear of burner 26 and passing over a carrier 36 containing the volatile metallic salts 37. In this embodiment, a single source of metallic salts will provide a source of ionized salt vapor for the flame 27 of the front burner 26 as well as for the front burner 12 and the glowing embers 13.

Having explained two preferred embodiments and four modifications thereof, it will be understood that the present invention employs various structural forms of volatile metallic salts which by their definition are already ionized. Melting and/or vaporizing these ionized metallic salts occurs at much lower temperatures than the prior art systems, thus it is possible to more precisely control the amounts of ionized salts that are carried into the primary combustion air which reaches the flames as a vapor and causes color enhancement characteristic of the ionized metal employed. Further, since the low temperature flame structure as well as the high temperature flame structure are both enhanced, flames which would ordinarily be invisible in a gas burner system now appear as long or elongated flames which were not present before and the long flames become more colored and brilliant as well as longer.

Tests have shown that the prior art glowing embers can be made to exhibit a visible flame curtain approximately 3 inches high where none appeared before the enhancement without any change in the amount of gas fuel being used.

Since the volatile metallic salts, if properly selected, will directly produce ionized metallic vapor particles at temperatures as low as 158° F. as shown in the accompanying Table 1, it will be appreciated that variations of the placement of the volatile metallic salts in keeping with the disclosure of the Figures and the explanation hereinbefore are now possible.

TABLE 1

TYPICAL VOLATILE SALT DATA

| Name | Melt °F. | Boil °F. | Color |
|---|---|---|---|
| Calcium Chloride | 1442 | | Yellow-Orange |
| Calcium Nitrate | 1041 | U | Yellow-Orange |
| Lithium Acetate | 158 | d | Red |
| Lithium Acetate | 1137 | 2417 | Red |
| Lithium Nitrate | 507 | d1112 | Red |
| Strontium Chloride | 1603 | 2282 | Red |
| Sodium Acetate | 615 | U | Yellow |
| Sodium Nitrate | 582 | U | Yellow |
| Sodium Chloride | 1474 | 2557 | Yellow |
| Cupric Chloride | 1148 | d1819 | Blue-Green |
| Cupric Acetate | 240 | d464 | Blue-Green |

This invention recognizes that gas flames have an invisible flame portion that may be made visible by including in the combustion air a small amount of vapor directly from solid phase high volatile metallic salts that are inherently ionized in their natural state at low or high temperatures.

What is claimed is:

1. A method of enhancing the visible length and color of high efficiency gas flames in an artificial gas log fireplace having a gas burner system, comprising the steps of:

selecting a high volatile low melting point highly concentrated metallic salt compound having the ability to emit light in the visible spectrum when the metallic salt ions absorb energy from the gas flame, placing said high volatile low melting point salt compound in a carrier placed in a high temperature area of the gas log fireplace adjacent to and outside of the direct flame area, generating an ionized metallic salt gaseous vapor by heating said low melting point highly concentrated metallic salt compound to a temperature below its melting point, directing said metallic salt gaseous vapor into the path of the combustion air being supplied to said gas burner system, and elevating the energy level of said ionized metallic gaseous vapor in the gas flame air mixture so that when the energized ionized metallic salt gaseous vapor cools, the ionized gas emits light in the visible spectrum characteristic of the metallic compound which enhances the length and color of the flames.

2. A method as set forth in claim 1 which further includes a step of providing said highly concentrated metallic salt compound in a carrier in granular form which permits said combustion air to sweep over and through the heated metallic salt compound and mix with ionized metallic salt gaseous vapor.

3. A method as set forth in claim 1 which further includes the step of placing the highly concentrated metallic salt compound in a carrier comprising a porous binder mixture of high temperature ceramic wool.

4. A method as set forth in claim 2 which further includes the step of placing the granular salt compound in a carrier comprising a porous thin metal mesh screen.

5. A method as set forth in claim 2 which further includes the step of placing the granular salt compound in a carrier comprising a rigid perforated trough.

6. A method as set forth in claim 5 which further includes the step of providing said perforated metal trough with a lining layer of porous ceramic wool.

7. A method as set forth in claim 3 which further includes the steps of depositing said highly concentrated metallic salt compound and said ceramic wool binder in or on the sides of the artificial gas logs said gas log system opposite said gas flame.

8. Apparatus for enhancing the visible length and color of high efficiency gas flames in an artificial gas log fireplace having a gas burner system, comprising:

a gas burner system, having hot gas flames, gas log means arranged over said gas burner system to permit passage of said gas flames in and through said gas log means, a highly concentrated volatile metallic salt compound, carrier support means for supporting said highly concentrated metallic volatile salt compound in an area beside and outside of said hot gas flames below the melting temperature of the salt compound, said carrier support means being positioned in said gas log system in the path of fresh combustion air being supplied to said hot gas flames, and said hot gas flames providing radiant heating to said volatile metallic salt compound to produce ionized gas vapor which is carried into said gas flames and energized by convection heating and by said gas flames so that when subsequently cooled the ionized gas vapor emits light in the visible spectrum which colors and appears to elongate said gas flames.

9. Apparatus as set forth in claim 8 wherein said carrier support means comprises a porous sheath.

10. Apparatus as set forth in claim 9 wherein said porous sheath comprises a layer of ceramic wool fiber.

11. Apparatus as set forth in claim 9 wherein said porous sheath comprises a metal mesh.

12. Apparatus as set forth in claim 8 wherein said carrier support means comprises a perforated trough.

13. Apparatus as set forth in claim 12 wherein said perforated trough is further provided with a layer of ceramic wool fiber to support granular highly concentrated volatile metallic compound salts.

14. Apparatus as set forth in claim 13 wherein said burner system comprises a lower front burner and a rear burner mounted above said lower burner.

15. Apparatus as set forth in claim 14 wherein said trough means is positioned juxtaposed a lower front burner of said gas burner system.

16. Apparatus as set forth in claim 14 wherein said perforated trough is positioned juxtaposed a rear burner of said gas burner system.

17. Apparatus as set forth in claim 8 wherein said volatile salt compound means comprise a mixture of volatile metallic compound salts and high temperature fibers forming a contiguous unit or layer of volatile metallic compound salts in a porous mass.

18. Apparatus as set forth in claim 17 wherein said porous mass of volatile metallic compound salts are attached to the sides of said logs of said burner system opposite said gas flame.

19. Apparatus as set forth in claim 17 wherein said porous mass of volatile metallic compound salts are placed juxtaposed said burner system.

20. A method of enhancing the color of gas flames in an artificial gas log fireplace comprising the steps of:

placing an ionized metallic salt compound outside of one of the hot reaction zones of the gas flames of a gas burner of the artificial gas log fireplace to drive off ionized atoms from the salt compounds which effect coloring of the gas combustion flames, characterized in that a highly concentrated ionized metallic salt compound is placed outside of the hot reaction zone beside said hot gas flames at a burner position where the temperature is substantially lower than said hot reaction zones of said hot gas flames, generating an ionized metallic salt gaseous vapor at the lower temperature burner position, mixing said metallic salt gaseous vapor into the combustion air, passing the gaseous vapor and air mixture into said hot reaction zones of said gas flames, and elevating the temperature and energy level of said ionized metallic salt gaseous vapor so that said gaseous vapor emits light upon cooling which enhances the length and color of the gas flames.

* * * * *